US010822787B2

(12) United States Patent
Bethencourt Cravid

(10) Patent No.: US 10,822,787 B2
(45) Date of Patent: Nov. 3, 2020

(54) LATTICE STRUCTURE

(71) Applicant: Manuel Fernando Bethencourt Cravid, Madrid (ES)

(72) Inventor: Manuel Fernando Bethencourt Cravid, Madrid (ES)

( * ) Notice: Subject to any disclaimer, the term of this patent is extended or adjusted under 35 U.S.C. 154(b) by 0 days.

(21) Appl. No.: 16/495,896

(22) PCT Filed: Mar. 22, 2018

(86) PCT No.: PCT/ES2018/070217

§ 371 (c)(1),
(2) Date: Sep. 20, 2019

(87) PCT Pub. No.: WO2018/178445

PCT Pub. Date: Oct. 4, 2018

(65) Prior Publication Data

US 2020/0109549 A1 Apr. 9, 2020

(30) Foreign Application Priority Data

Mar. 30, 2017 (ES) ..... 201730483

(51) Int. Cl.
*E04B 1/19* (2006.01)
*E04B 1/24* (2006.01)

(52) U.S. Cl.
CPC ..... *E04B 1/1903* (2013.01); *E04B 1/2403* (2013.01); *E04B 2001/196* (2013.01); *E04B 2001/1963* (2013.01); *E04B 2001/1984* (2013.01); *E04B 2001/1993* (2013.01)

(58) Field of Classification Search
CPC ..... E04B 1/1903; E04B 1/2403; E04B 2001/1963; E04B 2001/1984; E04B 2001/1993
See application file for complete search history.

(56) References Cited

U.S. PATENT DOCUMENTS 2,001,215 A * 5/1935 Ruppel ..... E04B 1/24 52/653.2
3,325,958 A * 6/1967 Moore ..... E04B 7/105 52/647
3,921,360 A * 11/1975 Baldwin ..... E04B 1/1906 52/655.2
3,968,808 A * 7/1976 Zeigler ..... E04B 1/19 135/145
4,129,975 A * 12/1978 Gabriel ..... A63H 33/101 52/655.2
4,247,218 A * 1/1981 Jeannin ..... E04B 1/1903 403/217

(Continued)

FOREIGN PATENT DOCUMENTS

CH 642130 A5 3/1984
CN 201221131 Y 4/2009

(Continued)

*Primary Examiner* — James M Ference
(74) *Attorney, Agent, or Firm* — Aslan Law, P.C.

(57) ABSTRACT

A lattice structure comprising a series of connecting rings or half-rings on which a series of orienting elements are secured. The orienting elements being equipped with holes and a slot in which the connecting rings or half-rings are disposed, as well as comprising profiles that are solidly connected using joining elements that extend through holes in the profiles.

11 Claims, 6 Drawing Sheets

(56) References Cited

U.S. PATENT DOCUMENTS 4,280,521 A * 7/1981 Zeigler ..... E04B 1/1909 135/120.3
4,566,818 A * 1/1986 Schwartz ..... E04B 1/1909 403/172
4,646,504 A * 3/1987 Britvec ..... E04B 1/1906 52/655.2
4,669,908 A * 6/1987 Simone ..... E04B 1/1906 403/170
4,838,003 A * 6/1989 Zeigler ..... E04B 1/3441 403/171
4,982,546 A * 1/1991 Lange ..... E04B 1/1906 403/174
5,036,641 A * 8/1991 Viry ..... E04B 1/19 52/646
5,076,724 A * 12/1991 Silber ..... E04B 1/1903 403/171
5,088,852 A * 2/1992 Davister ..... E04B 1/1906 403/143
5,265,395 A * 11/1993 Lalvani ..... B44C 3/123 403/176
5,318,470 A * 6/1994 Denny ..... A63H 33/10 446/126
5,326,337 A * 7/1994 Pardella ..... A63B 9/00 403/170
5,797,695 A * 8/1998 Prusmack ..... E04H 15/32 135/145
5,839,248 A * 11/1998 Liang ..... A47B 47/005 52/655.2
6,065,267 A * 5/2000 Fisher ..... E04C 3/08 52/655.1
6,205,739 B1 * 3/2001 Newlin ..... E04B 1/19 52/645
6,378,265 B1 * 4/2002 Konstandt ..... E04B 1/1903 403/171
6,672,789 B2 * 1/2004 Chen ..... F16B 7/185 403/171
6,679,644 B1 * 1/2004 Heller ..... A63H 33/10 135/127
6,857,246 B2 * 2/2005 Erbetta ..... E04H 15/36 135/124
8,590,216 B1 * 11/2013 Hurt, III ..... E04B 1/3211 52/81.3
8,820,025 B1 * 9/2014 Rochas ..... E04B 1/1906 52/638
9,157,235 B1 * 10/2015 Garvey ..... E04B 1/3211
9,719,243 B2 * 8/2017 Mason ..... F16B 7/185
2003/0226319 A1 * 12/2003 Richards ..... E04B 1/3211 52/80.1
2004/0128940 A1 * 7/2004 LaForge ..... E04H 12/10 52/655.1
2007/0044415 A1 * 3/2007 Merrifield ..... E04B 1/3441 52/633
2009/0313938 A1 * 12/2009 Li ..... E04B 1/19 52/656.9
2010/0005752 A1 * 1/2010 Hawkins ..... E04B 1/1909 52/655.1
2010/0139202 A1 * 6/2010 Athan ..... E04B 1/3211 52/655.1
2016/0168841 A1 * 6/2016 Zhou ..... E04B 1/1903 52/652.1
2020/0109549 A1 * 4/2020 Bethencourt Cravid ..... E04B 1/2403

FOREIGN PATENT DOCUMENTS

CN 105821963 A 8/2016
DE 25 33 721 A 2/1977

* cited by examiner

LATTICE STRUCTURE

CROSS-REFERENCE TO RELATED APPLICATIONS

This application claims priority to ES Patent Application No. P201730483 filed on Mar. 30, 2017, and to PCT Application No. PCT/ES2018/070217 filed on Mar. 22, 2018, the entire contents of which are hereby incorporated by reference.

OBJECT OF THE INVENTION

The object of the present invention is to present a lattice structure, which makes it possible to provide a removable three-dimensional module of any size.

This new lattice structure has applications in the industrial sector and in architecture, whenever providing a structure with these features is required.

BACKGROUND OF THE INVENTION

Currently, there are several types of lattice structures with various technical solutions.

Patent CN105821963A discloses an assembled double-ring node in a single-layer cell structure, which mainly comprises five parts including upper and lower centre rings, I-shaped connecting elements, a large sealing plate, a small sealing plate, high-strength screws, major rod elements and minor rod elements, wherein the upper and lower centre rings of the core are provided with screw holes; the wing edge parts of the I-shaped connecting elements are provided with screw holes; the large sealing plate and the small sealing plate are rectangular steel plates; the large sealing plate is welded with the I-shaped connecting elements; the small sealing plate is provided with screw holes, and is welded to the rod ends of the minor rod elements; the high-strength screw bolts are connected to the upper and lower node rings and the I-shaped connecting elements; the upper node ring and the small sealing plate are connected; the major rod elements and the minor rod elements are rectangular steel pipes.

The node rings can be only connected with the major rod elements and can be connected with both the major rod elements and the minor rod elements; a certain angle can be formed between the node rings and the rod elements. The node provided by the invention can be applicable to a single-layer space lattice structure, and has the characteristics that the mechanical property is good; the assembling performance is high; the construction speed is high; the construction quality can be easily controlled; the construction cost is low, and the like.

Said patent is based on single rings, unlike the present invention which is based on a double ring.

Patent CN201221131Y to a connecting structure used in a suspended-dome structure. An upper suspended monolayer spherical latticed shell, an oblique cord and ring cords are connected through a vertical pressure lever to form the suspended-dome structure. The oblique cord, the ring cords and the vertical pressure lever are connected through a hollow welded ball joint. Three holes are opened on the welded ball joint along the horizontal ring cord direction, wherein, two holes lead one ring cord to pass through the welded ball joint and to be anchor-connected through a casting anchor, and a connecting cord joint is anchored on a gasket and a screw cap inside the welded ball joint in another hole and is connected with the other ring cord through a screw shell; and another hole is opened on the welded ball joint along the oblique cord direction, and another connecting cord joint is anchored on the gasket and the screw cap inside the welded ball joint and is connected with the oblique cord through the screw shell.

Unlike the present invention, which guides the ring at one end of the rod and always in the same way.

The orienting element of the present invention is a piece that is separate from the rod and does not apply to all rods of the structure nor does it always have to be aligned with the rods.

The orienting element is applied to the rings in the position that works best and with the shape that is required, providing the assembly with greater versatility.

Patent DE2533721A defines a nodal connection for use on either flat or three-dimensional truss structures in buildings, involving a nodal piece with connecting apertures opening on its sheath for the attachment of truss rods. There is a hinge-type connection between an intermediate piece (5) and a bolt (2), between each of the rods being joined and the nodal piece (1). The hinge joint is in the form of a cylindrical intermediate piece (5), with an outer thread and a bolt (2), which can be turned into a cylindrical aperture with an inner thread in the nodal piece. The cross-section of the shaft of the bolt is less than the smaller cross-section of the funnel-shaped opening. The contact surfaces between the bolt head and the intermediate piece, and between the key socket and the intermediate piece, lie on concentric cone radii with a different centre from that of the nodal piece.

Unlike the present invention, to which it is similar only to the extent that it comprises a ring, the joining elements of the rod to the ring are very complex in comparison to the simplicity of the present invention.

In the current state of the art there is no lattice structure with the technical features described in the present invention.

DESCRIPTION OF THE INVENTION

Lattice structure comprising:

a series of connecting rings or half rings.

a series of orienting elements.

a series of primary profiles and secondary profiles.

Each of the connecting rings or half rings consists of a structural element allowing the orienting elements and the primary and secondary profiles forming the node of said lattice structure to become solidly connected by being supported on, embracing or being embraced by said connecting rings or half rings.

Each of the orienting elements consists of an element that positions the connecting rings or half rings in the chosen three-dimensional plane or space, embracing or being supported on the plane of said connecting rings or half rings by means of a slot; said orienting elements have a series of holes whereby they are solidly connected to said primary profiles and secondary profiles such that the distance between said holes defines the angle of the primary profiles and the secondary profiles.

The primary profiles and the secondary profiles have flat ends, with holes at the centre of their width and a diameter greater than the section of the connecting ring or half ring, and slots towards the lateral edge perpendicular to the length of said primary profiles and secondary profiles (if they are required to work under tensile or compressive forces, interchangeably) or with an angle in a direction opposite to their working shape (inwards for tensile force, outwards for compressive force).

The secondary profiles can be folded longitudinally at an angle greater than 90° such that when a secondary profile is solidly connected to another secondary profile by means of joining elements, the entire edge of said secondary profile is supported on the fold of the other secondary profile.

The V-shaped plates have openings at their ends to which rods or profiles are affixed; said plates are embraced by connecting rings or half rings by means of a groove; said plates fit into a secondary orienting element by means of a protrusion.

The secondary orienting element has a series of openings and a slot in its central part with a groove in the middle.

The present invention offers the following advantages:

The rings or half rings are easy to build if a special size is required.

A wide variety of diameters and sections can be provided.

They need little volume for transportation and storage.

The orienting elements are inexpensive since they are cut from a sheet, strip or plate for their manufacture by means of a press. A laser cut can be used in the case of special projects.

Due to their flat shape, they take up little space and are easy to transport and store.

If the rods are made from a plate, sheet or folded strip they can be stacked due to the fact that they occupy little space, which is less than any tubular profile, and can have any shape. This makes them easy to transport and store.

The profiles are easily adaptable to be coupled to the ring by forming and cutting the ends of the tube, or by means of other claimed methods.

DESCRIPTION OF THE DRAWINGS

In order to complement the description being made and with the object of helping to better understand the features of the invention, a set of figures has been attached to this specification as an integral part thereof, which represents the following in an illustrative and non-limiting manner.

PREFERRED EMBODIMENT OF THE INVENTION

Figure 1:
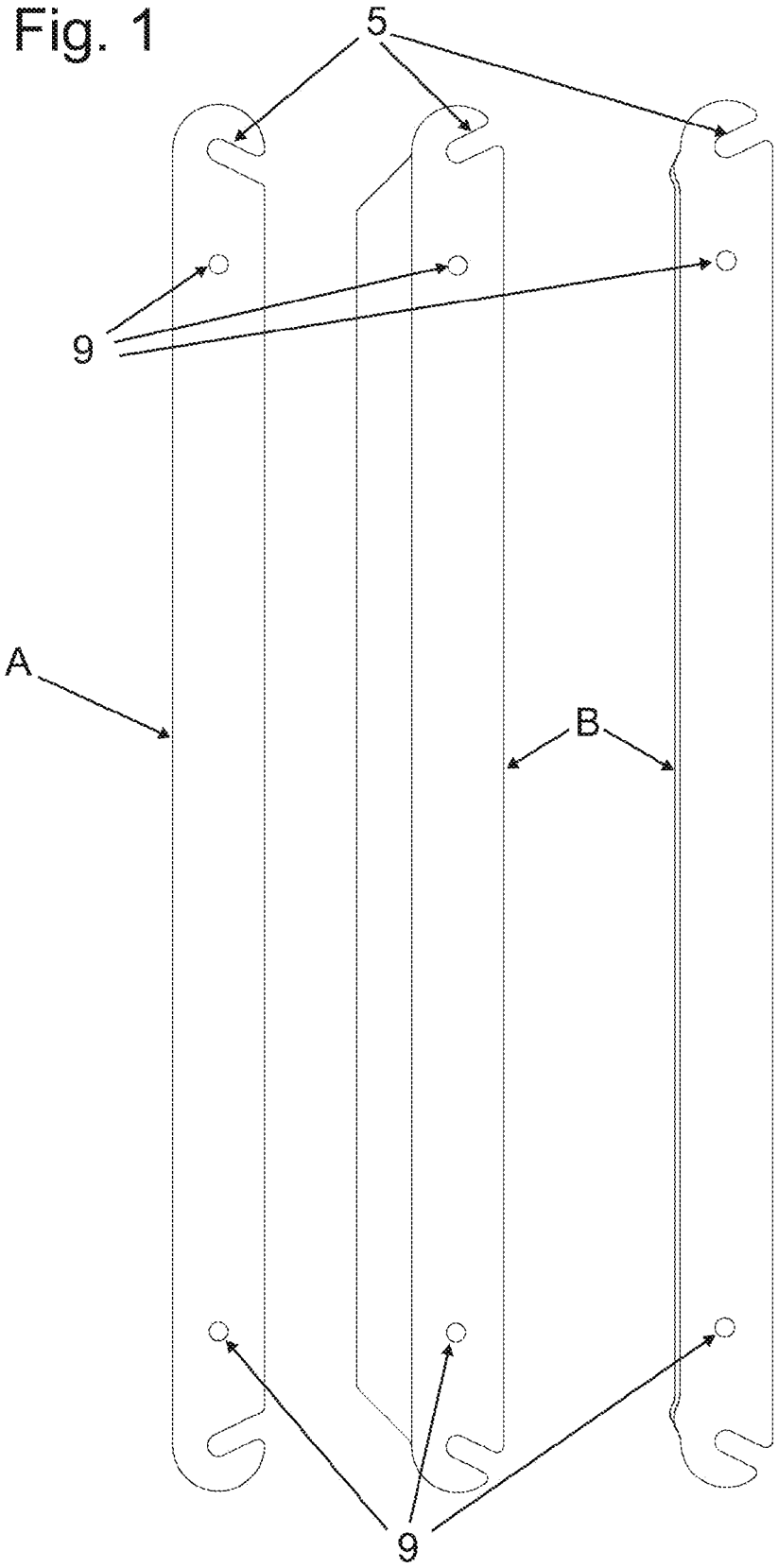
FIG. 1: Views of the lattice structure profiles showing the profile (A) under tensile force and two images of the profile (B) under compressive force, one without the fold and the other with the fold.
Figure 2A:
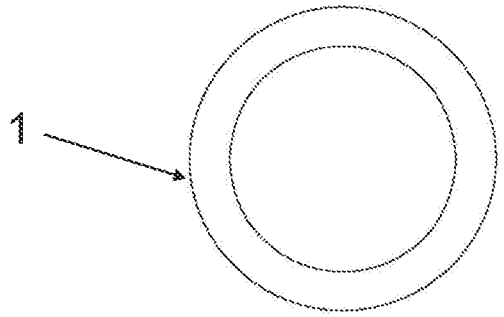
FIG. 2*a*: View of the ring of the lattice structure.
Figure 2B:
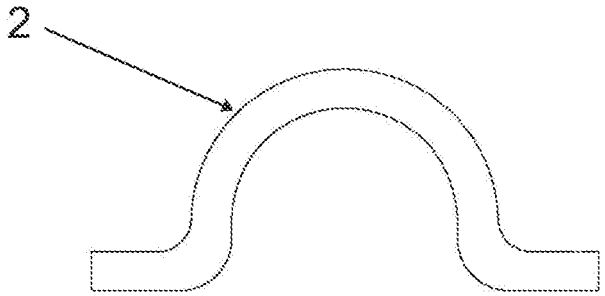
FIG. 2*b*: View of the half ring of the lattice structure.
Figure 3:
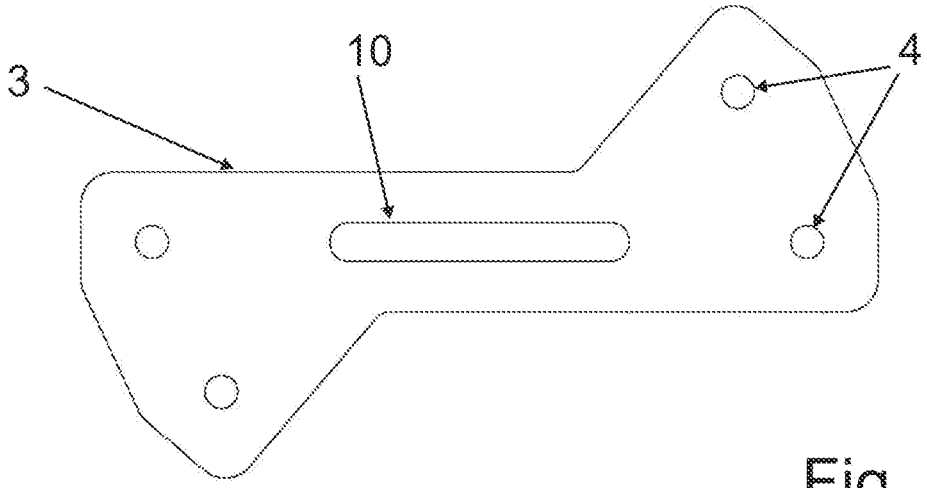
FIG. 3: Views of the orienting element of the lattice structure.
Figure 4A:
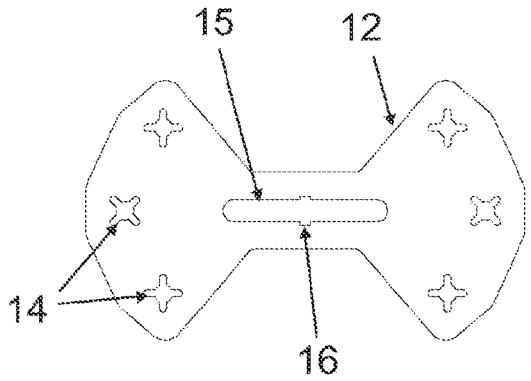
FIG. 4*a*: View of another preferred embodiment with the plate and the secondary orienting element of the lattice structure.
Figure 4B:
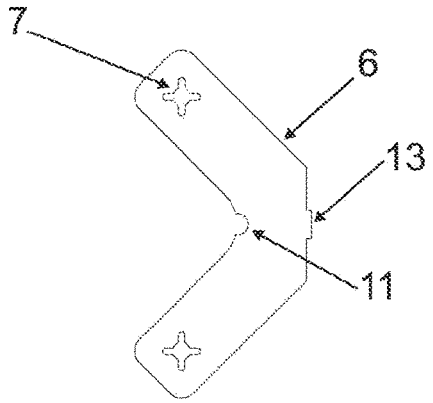
FIG. 4*b*: View of another preferred embodiment with the plate and the secondary orienting element of the lattice structure.
Figure 4C:
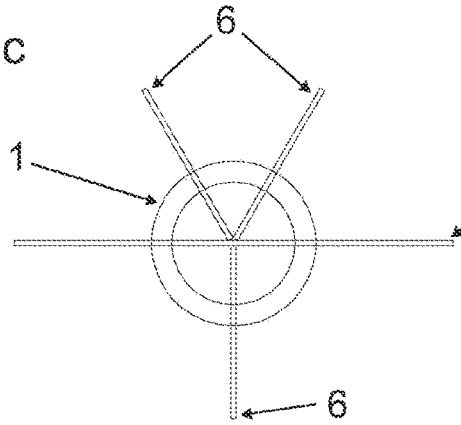
FIG. 4*c*: View of another preferred embodiment with the plate and the secondary orienting element of the lattice structure.
Figure 4D:
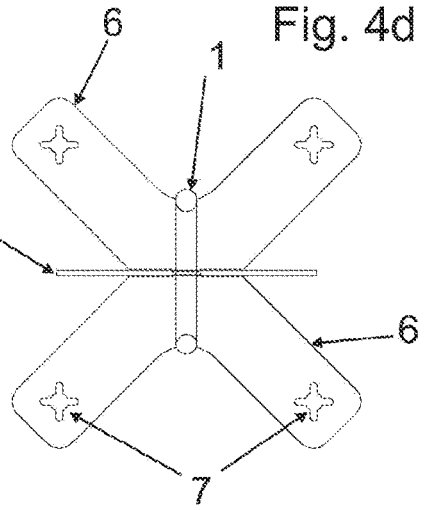
FIG. 4*d*: View of another preferred embodiment with the plate and the secondary orienting element of the lattice structure.
Figure 5:
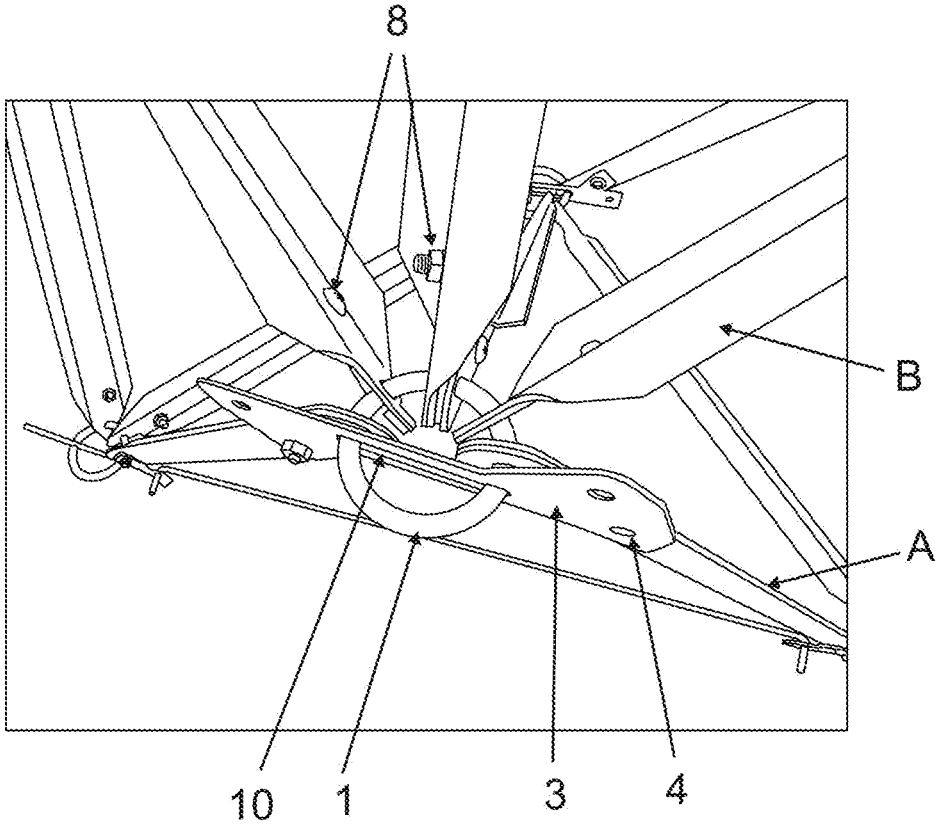
FIG. 5: View of a detail of the node of the lattice structure.
Figure 6:
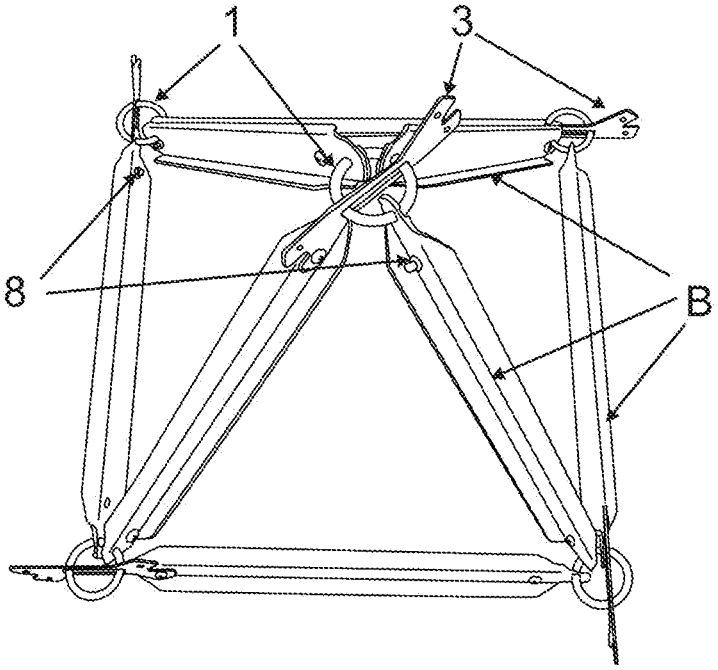
FIG. 6: View of a part/module of the lattice structure.
Figure 7:
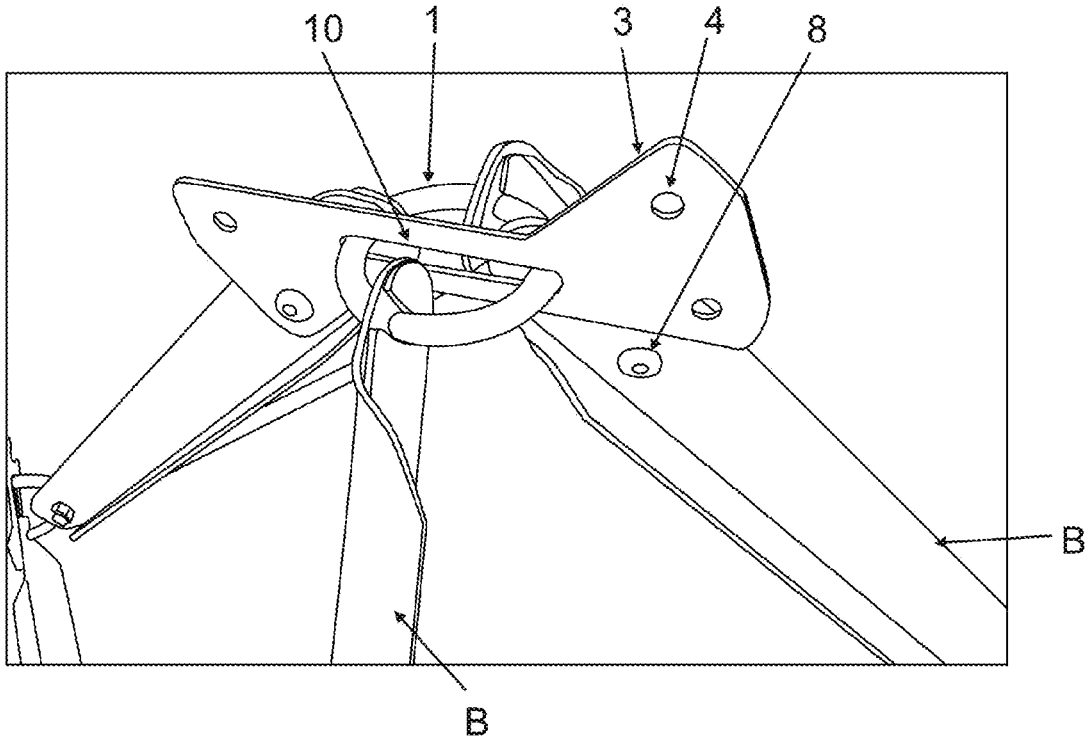
FIG. 7: View of another detail of the node of the lattice structure.

As shown in the figures attached hereto, the lattice structure is composed of a series of connecting rings (1) or half rings (2), a series of orienting elements (3) and a series of primary profiles (A) and secondary profiles (B).

Each of the connecting rings (1) or half rings (2) consists of a structural element allowing the orienting elements (3) and the primary profiles (A) and secondary profiles (B) forming the node of said lattice structure to become solidly connected by being supported on, embracing or being embraced by said connecting rings (1) or half rings (2).

The nodes of the lattice structure which require the structure to be as flat as possible is where the half rings (2) oriented towards the interior of the structure are used, to prevent half of the ring from protruding from the structure assembly if a full ring (1) were to be used.

Each of the orienting elements (3) consists of an element that positions the connecting rings (1) or half rings (2) in the chosen three-dimensional plane or space, embracing or being supported on the plane of said connecting rings (1) or half rings (2) by means of a slot (10); said orienting elements (3) have a series of holes (4) whereby they are solidly connected by means of joining elements (8) to said primary profiles (A) and secondary profiles (B) such that the distance between said holes (4) defines the angle of the primary profiles (A) and the secondary profiles (B) joined in a node and modifies the overall shape of the lattice structure.

Figure 8:
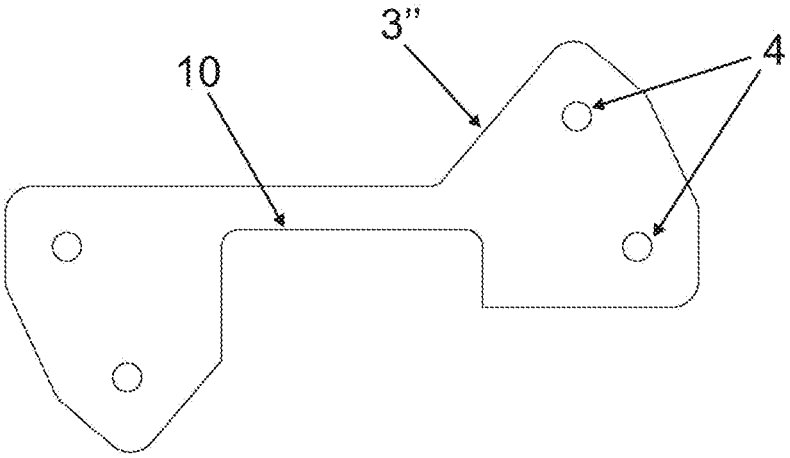
FIG. 8: Plan view of a variation of the orienting element with the slot open on one side.
Figure 9:
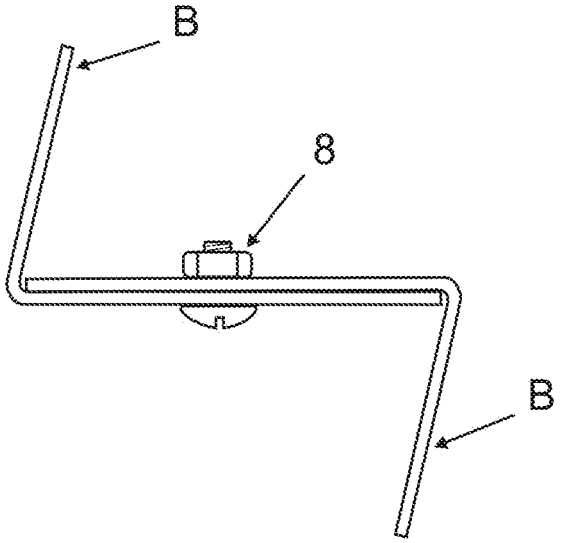
FIG. 9: View of a section of the two secondary profiles paired and affixed by means of the joining element.
Figure 10:
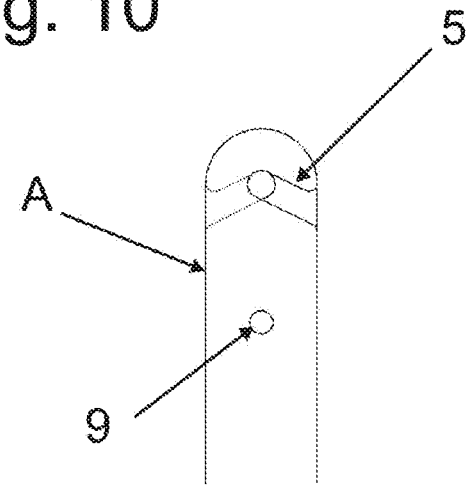
FIG. 10: View of a plan detail of the end of two primary profiles under tensile force and paired with their slots.

The orienting elements (3) have a variation in which the slot (10) is open on one of its sides, as shown in FIG. 8, such that the ring instead of being inserted inside the slot is only supported on the side thereof.

The primary profiles (A) and the secondary profiles (B) have flat ends, with holes (9) at the centre of their width and diameter greater than the section of the connecting ring (1) or half ring (2), and slots (5) towards the lateral edge perpendicular to the length of said primary profiles (A) and secondary profiles (B) (if they are required to work under tensile or compressive forces, interchangeably) or with an angle in a direction opposite to their working shape (inwards for tensile force, outwards for compressive force).

The primary profiles (A) or the secondary profiles (B) are joined in pairs by means of the 180° rotation along the longitudinal axis of one of them with respect to the other profile such that the holes (9) for the joining elements (8) and the slots (5) towards the sides match when they face each other as a consequence of the rotation of one profile with respect to another, providing a hole for the rings (1) or half rings (2).

The separation between the holes (4) of the orienting elements (3) can vary to modify the shape of the lattice structure, such that the angle between the primary profiles (A) or secondary profiles (B) and their length is modified. This way, a flat lattice structure could have undulations when the length of the profiles and the angle between them resulting from the separation between the holes (4) of the orienting elements (3) varies.

The secondary profiles (B) can be folded longitudinally at an angle greater than 90° such that when a secondary profile (B) is solidly connected to another secondary profile (B) by means of a 180° rotation along its longitudinal axis and with the joining elements (8) through the holes (9), the entire edge of said secondary profile (B) is supported on the fold of the other secondary profile (B). Thus, if the joining between two profiles is under compressive force, the rigidity is much greater because these folds of the secondary profiles (B) form a Z-shaped element between two of them.

In another preferred embodiment to form formwork structures, V-shaped plates (6) with openings (4) at the ends thereof are included in which corrugated steel rods are affixed; said plates (6) are embraced by the connecting rings (1) or half rings (2) by means of a groove (11) and fit into the orienting element (3') by means of a protrusion (13).

The orienting element (3') of this preferred embodiment has a series of openings (4) and a slot (10) in its central part with a groove (16) in the middle to which the protrusion (13) of the V-shaped plates (6) is anchored.

Having thus adequately described the nature of the present invention, as well as how to put it into practice, it must be added that the shape and materials of said invention may be modified, provided that it does not imply altering the characteristics claimed below.

The invention claimed is:

1. A lattice structure comprising:

connecting rings or half rings, each having a structural element wherein orienting elements and primary profiles and secondary profiles are configured to form a node of said lattice structure to become connected, being supported on, embracing or being embraced by said connecting rings or half rings, wherein said primary profiles including at least one flat primary profile, said secondary profiles including at least one folded secondary profile, said orienting elements, each having an element that positions the connecting rings or half rings in a three-dimensional space, embracing or being supported on the three-dimensional space of said connecting rings or half rings by means of a slot, said orienting elements have a series of holes whereby said orienting elements are connected to said primary profiles and secondary profiles such that a distance between said series of holes defines an angle of the primary profiles and the secondary profiles, and one of said at least one flat primary profile and one of said at least one folded secondary profile being folded with a V-shaped section and with a first face of the V-shaped section being longer than a second face of the V-shaped section, and in which ends of both the longer face of the at least one folded secondary profile and the at least one flat primary profile have holes at a center of a profile width of said primary profiles and secondary profiles and have slots towards a lateral edge of said primary profiles and secondary profiles, which are perpendicular to a longitudinal axis of said primary profiles and secondary profiles in a case where said primary profiles and secondary profiles are configured to work under tensile or compressive forces, interchangeably, or with an angle other than 90° configured to work only under tensile force or only under compressive force.

2. The lattice structure according to claim 1, wherein the primary profiles or the secondary profiles are joined in pairs in a case that the at least one flat primary profile overlaps with the at least one folded secondary profile.

3. The lattice structure according to claim 2, wherein the at least one folded secondary profile form an angle of less than 90° between two faces of the V-shaped section, such that the at least one folded secondary profile joins a second folded secondary profile which has been previously rotated 180° along a longitudinal axis of the at least one folded secondary profile and overlaps a longer flat face, both overlapping profiles form a profile with a Z-shaped section between said both overlapping profiles, a longitudinal edge of the longer flat face of a profile being supported on an inner area of a fold of the second folded secondary profile.

4. The lattice structure according to claim 2, wherein in a case of the at least one flat primary profile and in a case of the at least one folded secondary profile, overlap, the at least one flat primary profile has been previously rotated 180° along a longitudinal axis with respect to the at least one folded secondary profile, and the slots provide a hole for the rings or half rings.

5. The lattice structure according to claim 1, wherein the at least one folded secondary profile form an angle of less than 90° between two faces of the V-shaped section, such that the at least one folded secondary profile joins a second folded secondary profile which has been previously rotated 180 along a longitudinal axis of the at least one folded secondary profile and overlaps a longer flat face, both overlapping profiles form a profile with a Z-shaped section between said both overlapping profiles, a longitudinal edge of the longer flat face of a profile being supported on an inner area of a fold of the second folded secondary profile.

6. The lattice structure according to claim 1, wherein a central slot of an orienting element of said orienting elements has a groove.

7. The lattice structure according to claim 6, further comprising:

V-shaped plates that fit into the groove of a middle of the central slot of the orienting element;

wherein said V-shaped plates having openings at ends of said V-shaped plates where rods or profiles are affixed and which are embraced by said connecting rings or half rings in a groove.

8. The lattice structure according to claim 1, further comprising:

V-shaped plates that fit into a groove of a middle of a slot of an orienting element of said orienting elements;

wherein said V-shaped plates having openings at ends of said V-shaped plates where rods or profiles are affixed and which are embraced by said connecting rings or half rings in a groove.

9. The lattice structure according to claim 1, wherein the slot of the orienting elements is open on a first side such that the rings or half rings are supported only on the first side.

10. The lattice structure according to claim 1, wherein the primary profiles or the secondary profiles are joined in pairs in a case that the primary profiles, in a case that the secondary profiles, in the case that the at least one flat primary profile, or in the case that the at least one folded secondary profile, overlap, a first profile has been rotated 180° along a longitudinal axis with respect to a second profile, and the slots provide a hole for the rings or half rings.

11. The lattice structure according to claim 1, wherein the primary profiles or the secondary profiles are joined in pairs in a case that the primary profiles, in a case that the secondary profiles, overlap, and in a case that the at least one flat primary profile and in a case of the at least one folded secondary profile, overlap, a first profile has been rotated 180° along a longitudinal axis with respect to a second profile, and the slots provide a hole for the rings or half rings.

* * * * *